US007669516B2

(12) United States Patent
Cromm et al.

(10) Patent No.: US 7,669,516 B2
(45) Date of Patent: Mar. 2, 2010

(54) CYLINDER-PISTON ARRANGEMENT

(75) Inventors: Thomas Cromm, Weilburg-Kubach (DE); Ronald Sachs, Dortmund (DE); Stefan Zabeschek, Asslar-Berghausen (DE)

(73) Assignee: Pfeiffer Vacuum GmbH, Asslar (DE)

( * ) Notice: Subject to any disclaimer, the term of this patent is extended or adjusted under 35 U.S.C. 154(b) by 264 days.

(21) Appl. No.: 11/725,044

(22) Filed: Mar. 15, 2007

(65) Prior Publication Data

US 2007/0274847 A1 Nov. 29, 2007

(30) Foreign Application Priority Data

Mar. 18, 2006 (DE) ..... 10 2006 012 532

(51) Int. Cl.
*F04B 53/02* (2006.01)
*F16J 9/00* (2006.01)

(52) U.S. Cl. ..... 92/240; 92/244

(58) Field of Classification Search ..... 92/240, 92/242, 243, 244; 417/397
See application file for complete search history.

(56) References Cited

U.S. PATENT DOCUMENTS 2,106,829 A 2/1938 Christenson
2,318,757 A 5/1943 Christenson
2,431,957 A 12/1947 Noviss
2,471,477 A * 5/1949 Bonnaud ..... 92/244
3,343,844 A * 9/1967 Leschisin ..... 92/194
3,603,215 A * 9/1971 Leschisin ..... 92/240
5,921,755 A * 7/1999 Eldridge ..... 417/255

FOREIGN PATENT DOCUMENTS

| | | |
|---|---|---|
| AT | 0088733 | 6/1922 |
| DE | 0020343 | 3/2001 |
| DE | 0337298 | 3/2005 |
| JP | 1343975 | 12/1999 |

* cited by examiner

*Primary Examiner*—Thomas E Lazo
(74) *Attorney, Agent, or Firm*—Abelman, Frayne & Schwab

(57) ABSTRACT

A sealing arrangement which is designed for a cylinder-piston arrangement of a reciprocating piston vacuum pump for sealing a gap between a cylinder wall and a piston displaceable in the cylinder, includes at least one L-shaped annular seal having one of its leg secured on the piston for providing a static sealing, and its another free leg adjoining the cylinder wall for providing a dynamic sealing, and an annular guide member arranged on the piston between the piston and the cylinder on a side of the seal remote from a compression chamber of the pump.

4 Claims, 3 Drawing Sheets

CYLINDER-PISTON ARRANGEMENT

BACKGROUND OF THE INVENTION

1. Field of the Invention

The present invention relates to a cylinder-piston arrangement, in particular, to a cylinder-piston arrangement for a reciprocating piston vacuum pump, and more specifically, to a sealing arrangement for a cylinder-piston arrangement of a reciprocating piston vacuum—pump for sealing a gap between a cylinder wall and a piston displaceable in the cylinder, which sealing arrangement includes at least one L-shaped annular seal having one of its legs secured on the piston for providing a static sealing, and its another free leg adjoining the cylinder wall for providing a dynamic sealing 2. Description of the Prior Art Since several years, reciprocating piston vacuum pumps have successfully be used as so-called "dry forevacuum pumps." They find application primarily there where forevacuum, which is free from working fluid, e.g., oil, must be produced because a return flow of working fluid into a recipient cannot be tolerated. Piston vacuum pumps include one or more cylinders in which a piston reciprocates, whereby the volume of the compression chamber is periodically increases and decreases. Within a time period during which the volume of the compression chamber decreases, the gas is compressed and is expelled at the end of the piston movement.

For a proper function of a dry piston vacuum pump, sealing of the gap between the piston and the inner wall is very important. A L-shaped seal such as described in German Publication DE-OS 103 37 298, proved itself as a seal for sealing the gap. With such a seal, one of the seal leg is secured in the piston whereas the other leg is slightly inclined toward the cylinder axis, contacting with its end the inner wall of the cylinder. The above-described L-shaped seal provides for a construction with a small dead space. A suitable material selection permits operation of the pump free of a working fluid.

During a lasting operation, an L-shaped seal is subjected to large loads which could lead to a high wear that is incompatible with high requirements to endurance characteristics of such a seal.

Accordingly, the object of the present invention is a seal arrangement for a cylinder-piston arrangement of a piston vacuum pump and that would have, at the same time, a reduced wear.

SUMMARY OF THE INVENTION

This and other objects of the present invention, which will become apparent hereinafter, are achieved by providing a seal arrangement for a cylinder-piston arrangement of a reciprocating piston vacuum pump and including an annular guide member arranged on the piston between the piston and the cylinder on a side of the seal remote from a compression chamber of the pump.

The guide member takes over the mechanical load applied to the seal and which is produced by the oscillating movement that periodically is superimposed on the linear movement, and which is particularly pronounced in the cusp points. As a result of reduced load, the service life of the seal increases. Simultaneously, the guide member reduces noise of the cylinder-piston arrangement.

Further, a combination of the guide member with a damping member, which is arranged between the piston and the free leg of the seal, further reduces noise of the cylinder-piston arrangement.

According to an advantageous embodiment of the present invention, the damping member is arranged in a circular groove having at least one mill-out recess. The recess provides an expansion space in which the damping member can expand when a pressure load is applied thereto. This again prevents the damping element from pressing the L-shaped seal with a great force against the cylinder wall when the damping element is subjected to a pressure load, which limits friction at least locally.

Advantageously, another seal having an L-shaped cross-section is provided at an end of the piston remote from a compression chamber of the pump, with a free leg being oriented in a direction remote from a compression chamber.

This further increases the tightness of the entire arrangement, improves guidance of the piston, and reduces wear and noise.

According to a further advantageous embodiment, the guide member has a stiffness that is greater than a stiffness of the L-shaped seal but which is sufficiently small to insure a sufficient elasticity of the guide member. This further increases the advantages the guide member provides.

Advantageously, the another L-shaped seal cooperates with another guide member, which further noticeably reduces the noise generated by the cylinder-piston arrangement.

Advantageously, the diameter of the guide member is smaller than the inner diameter of the cylinder. This means that the guide member engages the cylinder inner wall only when it is really necessary. This is the case when a load, which is caused by the inclination of the piston axis and is generated by the oscillation movement of the piston, is too high. At small loads, the guide member does not contact the inner wall of the cylinder, so that no abrasion takes place.

A particular simple and favorable assembly and, thereby, an easy replacement of the component is insured when the seal and the guide member are formed integrally as a one-piece component. In this way, the costs are reduced as a result of reduction of costs of materials and reduced manufacturing time.

The novel features of the present invention, which are considered as characteristic for the invention, are set forth in the appended claims. The invention itself, however, both as to its construction and its mode of operation, together with additional advantages and objects thereof, will be best understood from the following detailed description of preferred embodiment, when read with reference to the accompanying drawings.

DETAILED DESCRIPTION OF THE PREFERRED EMBODIMENTS

Figure 1:
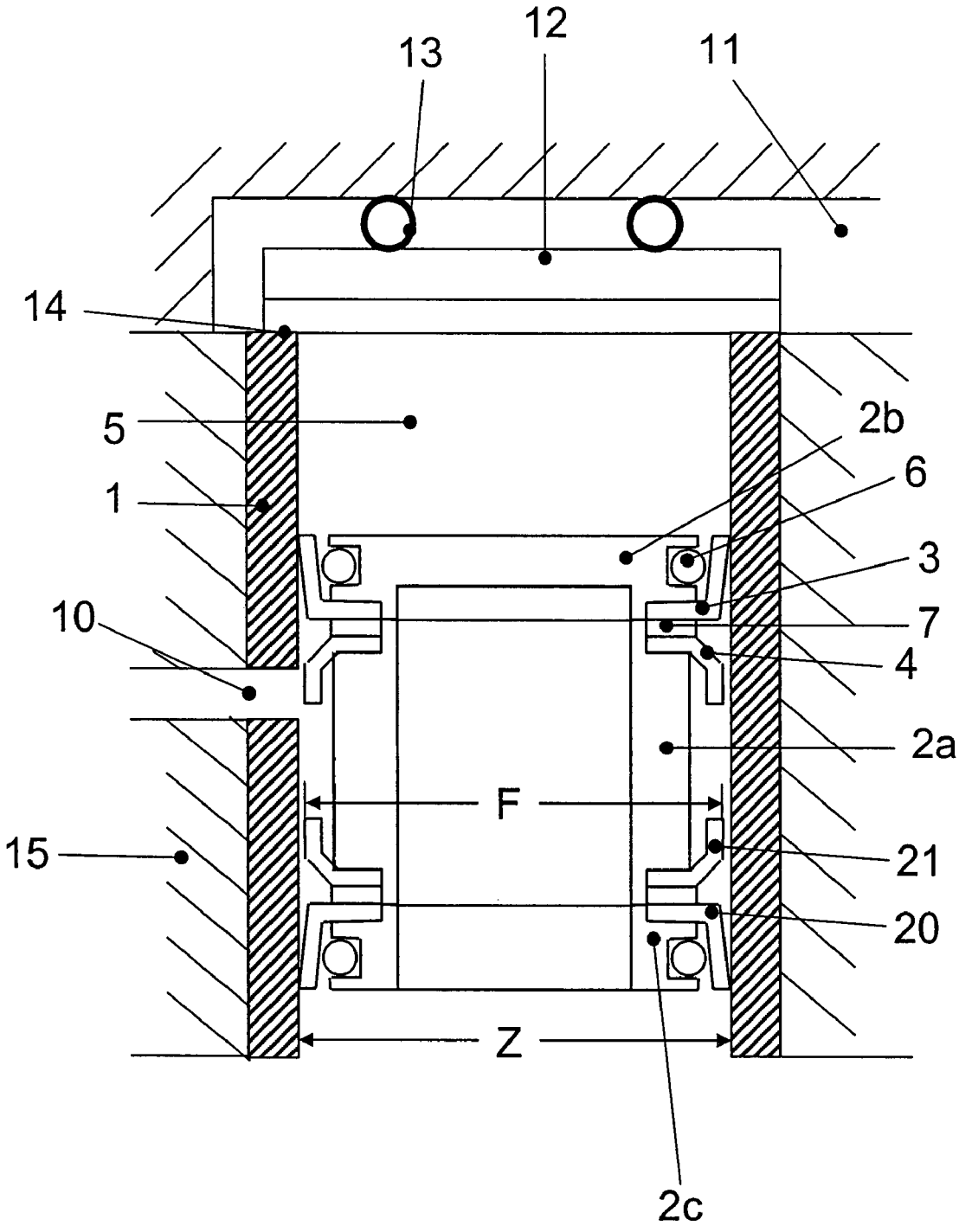
FIG. 1 a cross-sectional view of a cylinder-piston arrangement of a piston vacuum pump.

A cylinder-piston arrangement of a piston vacuum pump, a cross-sectional view of which is shown in FIG. 1, includes a cylinder 1 located in a housing 15 of the pump, and a piston reciprocating in the cylinder 1. As a result of reciprocation of the piston, the volume of the compression chamber 5, which is defined by the cylinder, periodically increases and decreases. A cusp point of the reciprocating movement of the piston, further "a lower cusp point" is characterized by the gas suction process. To this end, there is provided, in cylinder wall, an opening 10 or a plurality of openings communicating with a common inlet channel. The other cusp point, further "an upper cusp point," is characterized by a gas expelling process. To this end, the piston is displaced in the cylinder so far that the valve cover 12 is lifted from the valve seat 14 and the counter-biasing force of the valve spring 13 is overcome. The compressed gas is then expelled through the gas outlet 11.

In the embodiment shown in FIG. 1, the piston is formed of three parts and has a piston cover 2*b*, a piston sleeve 2*a*, and a piston head 2*c*. Piston rod means, which is connected with the piston and imparts to the piston its reciprocating movement, is not shown.

On the piston, an annular L-shaped seal having a L-shaped cross-section 3, is arranged. The seal seals the gap between the piston and the cylinder wall. One leg of the L-shaped seal is secured to the piston, whereas another leg remains free and slightly presses against the cylinder wall. Because the piston vacuum pump is formed as a dry pump, no working fluid is provided between the piston and the cylinder. Correspondingly, the material pairing of the seal 3 and the cylinder 1 is selected, e.g., for the seal, a plastic material with PTFE-components is selected, while for the cylinder, metal alloys are used, e.g., on the aluminum basis, eventually, with a coating.

The piston performs a reciprocating movement which is linear to a most possible extent only theoretically. In practice, oscillating movements also occur, which correspond to tilting of the piston axis relative to the cylinder axis. As a result, the seal is subjected to non-uniform loads, in particular, in cusp points. To reduce this non-uniformity, there is provided, according to the present invention, a guide member 4. The guide member 4 is formed as an annular member and has, in the embodiment discussed here, a two-leg cross-section. One of the legs of the guide member 4 is secured in the piston, whereas the other leg projects into the gap between the cylinder wall and piston. The diameter F of the annular guide member 4 is smaller than the inner diameter Z of the cylinder 1. The other, free leg of the guide member 4 is so formed that it is more rigid than the seal. Thereby, it is achieved that the oscillating movement initially loads the seal. If the deviation is too strong, the guide member 4 contacts the cylinder wall and the load is transmitted from the seal to the guide member 4, i.e., is distributed therebetween. The rigidity or stiffness of the guide member is so selected that it is sufficiently small and that the guide member is also resiliently deflectable. This is important so that the oscillating movement and, thus, impacts of the guide member do not lead to a noticeable noise. The smaller diameter of the guide member 4 is only then replaced when it becomes used and not as a result of being subjected to noticeable wear during a normal linear movement of the piston and which might have been caused by friction of the cylinder wall. It is possible to use other embodiments of a guide member as long as an equivalent effect is achieved. Thus, instead of a two-leg cross-section, a guide member having a rectangular cross-section can be used. In this case, the guide member is located in a groove formed in the piston, with a possibility of displacement radially transverse to the piston axis. In this case, the annular guide member can be supported by a spring or resilient element or be itself formed of an elastic material.

For damping noise, there is provided a damping member 6 which is formed in the embodiment shown in the drawings, as an elastomeric ring. The damping member 6 prevents the free leg of the L-shaped seal from applying pressure to the piston sleeve 2*a* during oscillation of the piston, which might have caused noise. The elastomeric ring is compressed in the region of its elastic deformation in case of see-saw movement or deviation of the piston from the cylinder center. The compression energy is produced by the see-saw movement, which thus is damped.

In order to facilitate mounting of the seal and the guide member, a spacer 7 is provided therebetween.

In order to improve the function of the piston vacuum pump, on one hand, and for an improved guidance, on the other hand, there is provided, at the piston end remote from the compression chamber, a second seal 20 arranged in a mirror-inverted manner. The second seal 20 likewise has an L-shaped cross-section and cooperates with a second guide member 21.

Figure 2:
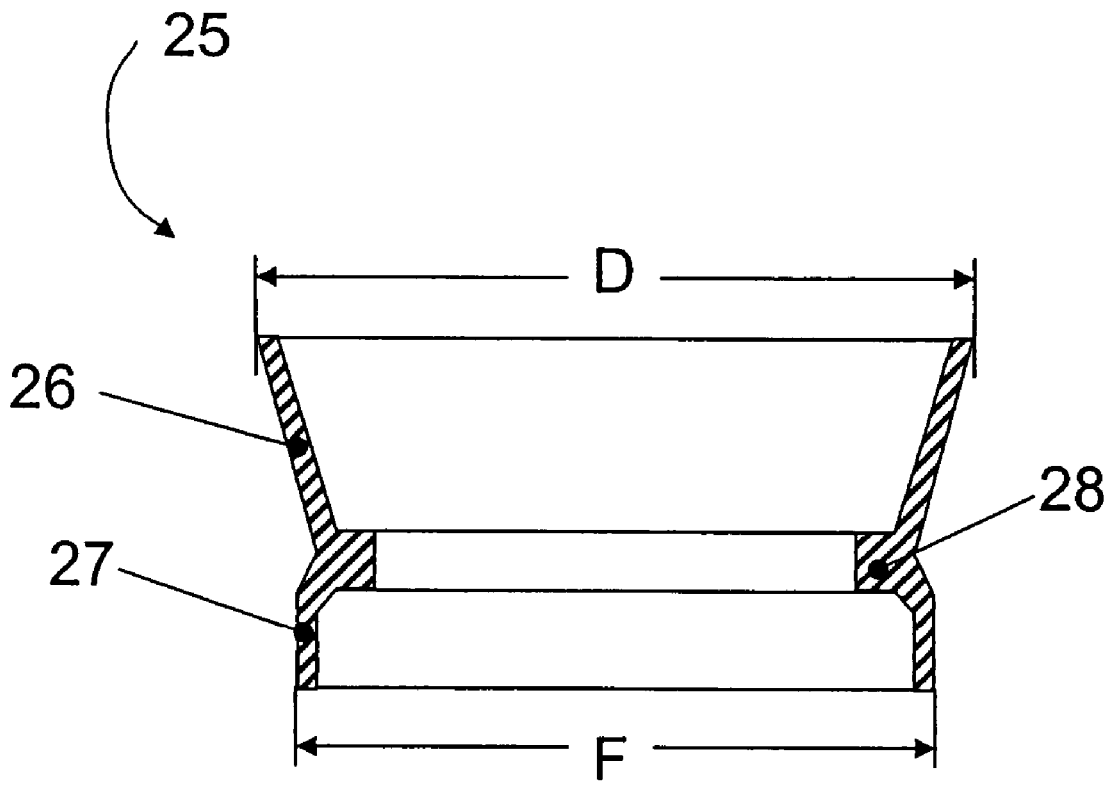
FIG. 2 a cross-sectional view of an integrated component.

The seal arrangement can be simplified. It is possible to form a one-piece component that would combine the functions of both the seal and the guide member. Such a component is shown in FIG. 2. The integral component 25 is formed as an annular member and has a three-leg cross-section. One of the legs, the leg 28 serves as a retaining section with which the component can be held on the piston. The second leg 26 serves as a sealing element and has a maximal diameter D. The third leg 27 takes over the function of the guide member. The maximal diameter F of the third leg 27 is smaller than the maximal diameter D of the second leg 26. Thereby, it is insured that the third leg 27 would contact the cylinder wall only during the oscillating movements of the piston. The stiffness of the second leg 26 is smaller than that of the third leg 27 which is sufficiently weak to produce a resilient and damping effect.

Figure 3A:
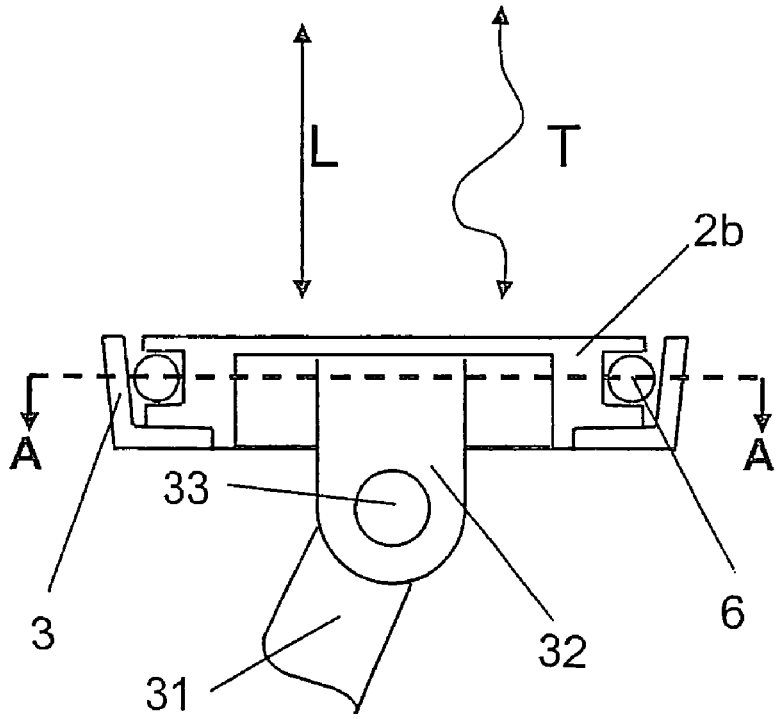
FIG. 3*a* a side view of a piston cover.
Figure 3B:
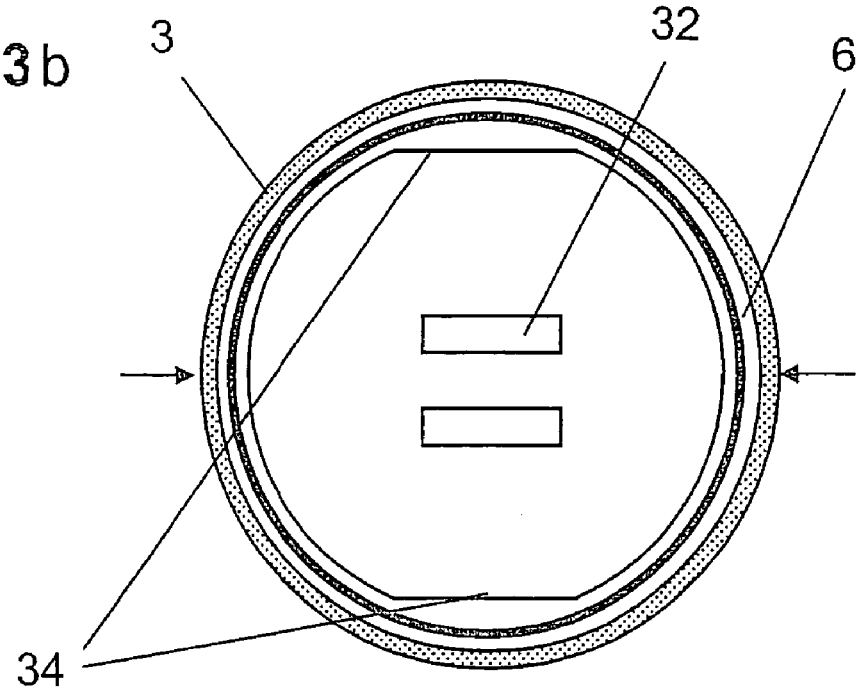
FIG. 3*b* a cross-sectional view along line B-B in FIG. 3*a*.

An improved embodiment of the present invention is shown in FIGS. 3*a* and 3*b*. FIG. 3*a* shows a cross-section of the piston cover 2*b* along the piston axis. A piston pin 33 is held in a pin eyelet 32 and extends through the eye of a piston rod 31 and is rotatably supported there by a roller bearing, not shown. In the drawing of FIG. 3*a*, the arrows above the piston cover show possible movements of the piston, an ideal, linear movement (L) (left arrow), and a see-saw movement T (right arrow). FIG. 3*b* shows a cross-sectional view along line B-B in FIG. 3*a*. The small arrows show points of main loading resulting from the see-saw movement T. In both FIGS. 3*a*, 3*b*, numeral 3 designates the circular, L-shaped seal 6 and the damping member formed as elastomeric ring. Upon occurrence of a see-saw movement, the L-shaped seal will be pressed in the direction of the middle of the piston, as shown with small arrows in FIG. 3*b*. At a corresponding strong deviation, the seal 6 becomes deformed in its elastic region. According to the invention, there is provided at least one mill-out recess 34 along the circumference of a circular groove in which the damping member is guided. This mill-out recess 34 provides space into which the damping member can expand during deformation. Without this space, clamping could have occurred, and therefore, the damping element feels the gap between the interior of the groove and the L-shaped seal completely and insures that the seal applies a high pressure to the cylinder wall. In the embodiment shown in FIG. 3*b*, two mill-out recesses 34 are shown that are offset by 90° along the circumference with respect to main loaded points.

Though the present invention was shown and described with references to the preferred embodiment, such is merely illustrative of the present invention and is not to be construed as a limitation thereof and various modifications of the present invention will be apparent to those skilled in the art. It is therefore not intended that the present invention be limited to the disclosed embodiment or details thereof, and the present invention includes all variations and/or alternative embodiments within the spirit and scope of the present invention as defined by the appended claims.

What is claimed is:

1. A sealing arrangement for a cylinder-piston arrangement of a reciprocating piston vacuum pump for sealing a gap between a cylinder wall and a piston displaceable in the cylinder, the sealing arrangement comprising at least one L-shaped annular seal having one leg thereof secured on the piston for providing a static sealing, and another free leg thereof adjoining the cylinder wall for providing a dynamic sealing; and an annular guide member arranged on the piston between the piston and the cylinder on a side of the seal remote from a compression chamber of the pump, wherein the seal and the guide member are formed integrally with each other as a one-piece component.

2. A sealing arrangement for a cylinder-piston arrangement of a reciprocating piston vacuum pump for sealing a gap between a cylinder wall and a piston displaceable in the cylinder, the sealing arrangement comprising at least one L-shaped annular seal having one leg thereof secured on the piston for providing a static sealing, and another free leg thereof adjoining the cylinder wall for providing a dynamic sealing; and an annular guide member arranged on the piston between the piston and the cylinder on a side of the seal remote from a compression chamber of the pump and having an outer diameter smaller than an inner diameter of the cylinder, wherein the guide member has a multi-leg cross-section, with one leg being fixed on the piston for securing an axial position of the guide member.

3. A sealing arrangement for a cylinder-piston arrangement of a reciprocating piston vacuum pump for sealing a gap between a cylinder wall and a piston displaceable in the cylinder, the sealing arrangement comprising at least one L-shaped annular seal having one leg thereof secured on the piston for providing a static sealing, and another free leg thereof adjoining the cylinder wall for providing a dynamic sealing; an annular guide member arranged on the piston between the piston and the cylinder on a side of the seal remote from a compression chamber of the pump and having an outer diameter smaller than an inner diameter of the cylinder; and a further seal having an L-shaped cross-section and provided at an end of the piston remote from a compression chamber of the pump, with a free leg being oriented in a direction remote from a compression chamber.

4. A sealing arrangement as set forth in claim 3, comprising another annular guide member located between the compression chamber and the further seal and arranged on the piston between the piston and cylinder.

* * * * *